US005514268A

United States Patent [19]

Ohmi

[11] Patent Number: 5,514,268

[45] Date of Patent: May 7, 1996

[54] SYSTEM AND METHOD OF COOLING APPARATUS

[75] Inventor: Tadahiro Ohmi, Miyagi, Japan

[73] Assignee: Takasago Netsugaku Kogyo Kabushiki Kaisha, Tokyo, Japan; a part interest

[21] Appl. No.: 150,056

[22] PCT Filed: May 13, 1992

[86] PCT No.: PCT/JP92/00609

§ 371 Date: Jan. 13, 1994

§ 102(e) Date: Jan. 13, 1994

[87] PCT Pub. No.: WO92/20979

PCT Pub. Date: Nov. 26, 1992

[30] Foreign Application Priority Data

May 20, 1991 [JP] Japan ..... 3-143966

[51] Int. Cl.[6] ..... C02F 1/78

[52] U.S. Cl. ..... 210/192; 210/198.1; 210/760; 165/2

[58] Field of Search ..... 210/760, 192, 210/198.1; 165/2

[56] References Cited

U.S. PATENT DOCUMENTS

| | | | |
|---|---|---|---|
| 2,405,553 | 8/1946 | Allison | 210/760 |
| 3,326,747 | 6/1967 | Ryan et al. | 210/760 |
| 4,172,786 | 10/1979 | Humphrey et al. | 210/760 |
| 4,229,202 | 10/1980 | Mullerheim et al. | 210/760 |
| 4,548,716 | 10/1985 | Boeve | 210/760 |
| 5,106,497 | 4/1992 | Finnegan | 210/760 |
| 5,145,585 | 9/1992 | Coke | 210/760 |

FOREIGN PATENT DOCUMENTS

| | | |
|---|---|---|
| 62-125276 | 6/1987 | Japan . |
| 62-266375 | 11/1987 | Japan . |
| 1-131865 | 5/1989 | Japan . |

*Primary Examiner*—Neil McCarthy
*Attorney, Agent, or Firm*—Young & Thompson

[57] ABSTRACT

This invention intends to provide an apparatus-cooling system high in cooling efficiency and easy in maintenance as well as a method to cool an apparatus. The invention is characterized in that an apparatus-cooling water system comprising at least a water tank (1) for storing pure water, pipings (3), (5) for outwardly introducing pure water from the water tank and returning the water to the tank, respectively, and pump (2) for passing pure water through the pipings is provided with an ozonator (6) for supplying ozone into the pure water.

9 Claims, 3 Drawing Sheets

SYSTEM AND METHOD OF COOLING APPARATUS

FIELD OF THE INVENTION

The present invention relates to an apparatus cooling system for, for example, cleanrooms, and in particular to a system and method for cooling an apparatus which is easy to maintain.

BACKGROUND OF THE INVENTION

It is important to remove the heat generated by various apparatuses in the immediate vicinity of the apparatuses in order to minimize the power necessary to conduct air temperature regulation in a cleanroom, and in order to reduce the operating costs of the cleanroom. The main parts of a common apparatus cooling system are shown in FIG. 4; such a system comprises municipal water water tank 1, circulation pump 2, strainer 8, heat exchanger 7, and piping, and conducts the removal of heat from the apparatuses using municipal water at a temperature within a range of 20°–25° C.

However, because various substances are dissolved or dispersed in municipal water, when municipal water is used as cooling water, the following problems occur. For example, suspended matter contained in the municipal water, such as sand, dirt, silica, or the like accumulates in the piping, and may lead to the blockage of the piping. Accordingly, in order to remove the suspended matter present in the cooling water, a strainer 8 is attached upstream from the use point; however, it is impossible to remove all suspended matter, and thus very small suspended matter which is able to pass through the strainer accumulates steadily in the piping, and this finally leads to the blockage of the piping.

On the other hand, Ca ions and the like are also dissolved in municipal water, and when this is heated at the use point, calcium carbonate, which is not readily soluble, is produced, and this is precipitated and adheres to the piping walls. Furthermore, dissolved silica components are also steadily precipitated and adhere to the inner walls of the piping. As a result, the cooling efficiency decreases markedly, and furthermore, water flow resistance increases.

The problems stated above are present when municipal tap water is used in apparatus cooling systems, and thus in order to solve this problem, attempts have been made to use pure water from which all precipitated matter has been removed in place of the municipal water. However, in such cases, while obstructions occurring as the result of the precipitation of suspended matter or the accumulation of dirt or the like were eliminated, problems occurred in which bacterial strains appeared and multiplied within the apparatus cooling system. The bacteria which appeared were attached to the interior of the piping and the heat exchanger, in the same way as the suspended matter and the precipitated matter above, and thus the heat exchanging efficiency was reduced, and an increase in water flow resistance within the piping system was experienced, and blockage of the piping system eventually occurred.

In light of the above circumstances, the present invention has an object thereof to provide an apparatus cooling system which utilizes pure water from which suspended matter and precipitated matter have been removed as the apparatus cooling water, and which suppresses the appearance of bacteria, has high cooling efficiency, and is easy to maintain.

SUMMARY OF THE INVENTION

The first essential feature of the present invention is that an apparatus cooling system is provided with a water tank for storing pure water, pipings for outwardly introducing pure water from said water tank and returning this water to the water tank, and a pump for passing pure water through the pipings, is provided with a mechanism for supplying ozone into the pure water.

The second essential feature of the present invention is that a method for cooling apparatuses in which pure water is circulated and apparatuses are cooled is characterized in that pure water containing ozone is employed as the pure water.

Embodiment Examples

Hereinbelow, the apparatus cooling method and system of the present invention will be explained using diagrams. FIG. 1 is a concept diagram showing an example of the compositon of the system of the present invention.

In FIG. 1, reference 1 indicates a water tank for pure water; pure water is supplied from a water purifying apparatus (not depicted in the diagram) via piping 9 which connects the pure water apparatus and the water tank 1. The pure water of water tank 1 is pressurized by circulation pump 2, passes through water supply piping 3, and is sent to each apparatus cooling portion, represented by use points 4. The pure water which is sent to each apparatus cooling portion collects the heat which is generated by the apparatuses, passes through return piping 5, and is sent to heat exchanger 7; in heat exchanger 7, the heat, collected from the apparatuses is discharged. An ozone supplying apparatus 6 is connected to return piping 5 at a point downstream from heat exchanger 7; after ozone has been poured into the pure water from ozone supplying apparatus 6, the pure water is returned to water tank 1. Furthermore, in order to remove the dirt or dead bacteria present at the initiation of system operation, it is possible to provide a filter in the piping.

It is preferable that the materials used for the members utilized in the apparatus cooling system be such that dirt or substances which will precipitate as a result of the heat of the apparatuses will not leach into the cooling water, and which are capable of withstanding pressure of approximately 10 $kg/cm^2$; for example, stainless steel, hardened vinyl chloride, polyethylene lined cast iron pipe, or the like, may be employed.

Water tank 1 generally comprises a container, a cooling water input port, an exit port, a pure water supply port, and a water gauge; when the water level within the container decreases, pure water is supplied from the pure water apparatus via piping 9, and thus the water level is maintained at a predetermined level.

Any type of pump may be used as circulation pump 2, provided that this pump is capable of pressurizing the cooling water to a level of 5 $kg/cm^2$ or more; for example, a centrifugal pump or the like may be employed.

The heat exchanger 7 should preferably be of a closed type in order to prevent the entry of bacteria; for example, a plate type heat exchanger may be employed.

The ozone supplying apparatus 6 utilized in the present invention comprises an ozone generating portion and an ozone distributing portion. Any method may be used for the ozone generating method; for example, the silent discharge method, the photochemical reaction method, the electrolytic method, the radiation exposure method, or the high frequency electrolytic method or the like may be employed. Furthermore, any method may be employed as the ozone distributing method insofar as such a method is capable of supplying ozone generated by the ozone generating portion into the cooling water; for example, a method utilizing an ejector, a bubble tower, a rotary atomizer, a bubble agitation tank, or the like, may be employed.

The ozone supplying apparatus 6 may be installed at any position along the cooling water piping system in the apparatus cooling system; however, it is preferable that this ozone supplying apparatus be provided immediately before the water tank, which is the position at which bacteria are most likely to appear, and the ozone supplying apparatus is not limited to one position, but may be installed at 2 or more positions. Furthermore, the supply of ozone may be conducted continuously or intermittently.

An ozone concentration of several ppb in the cooling water of the present invention has exhibited some antibacterial effects; however, in order to completely prevent the appearance of bacteria, a concentration of 50 ppb or more at all points in the cooling water system is preferable. Furthermore, it is preferable that the upper limit of this ozone concentration be on the level of 1 ppm, from the point of view of the corrosion of the cooling system.

As a result of autolysis, the ozone concentration even in pure water declines over time. Accordingly, in order to maintain an ozone concentration of 50 ppb at the position which is furthest removed from the supply point when the piping of the cooling water system is long, and in order to keep the ozone concentration at the supply point under 1 ppm, it is preferable that, rather than a single ozone supply point, a number of ozone supply points be provided.

Furthermore, the pure water which is used in the present invention is water having a specific resistance of 1 MΩ.cm or more, and which contains almost no suspended matter or ions or chemical compounds which are precipitated as a result of heating. This pure water may be obtained, for example, by first passing municipal water through a reverse osmosis apparatus, and then treating this water in an ion exchange column.

Function

In the cooling water piping system described above, an ozone supplying apparatus is provided, and the ozone concentration in the cooling water is constantly maintained at a level of 50 ppb or more, and thereby, it is possible to prevent the appearance of various bacteria, and it is possible to maintain the initial high cooling efficiency.

| (Description of the References) | |
|---|---|
| 1 | water tank |
| 2 | circulation pump |
| 3 | water supply piping |
| 4 | use point (apparatus) |
| 5 | return piping |
| 6 | ozone pouring apparatus |
| 7 | heat exchanger |
| 8 | strainer |
| 9 | pure water (municipal water) supply piping |
| 10 | silent discharge type ozone generator |

-continued

| (Description of the References) | |
|---|---|
| 11 | ejector. |

BEST MODE FOR CARRYING OUT THE INVENTION

Hereinbelow, the present invention will be explained in detail on the basis of embodiments; however, it is of course the case that the present invention is in no way limited to the embodiments described.

Figure 1:
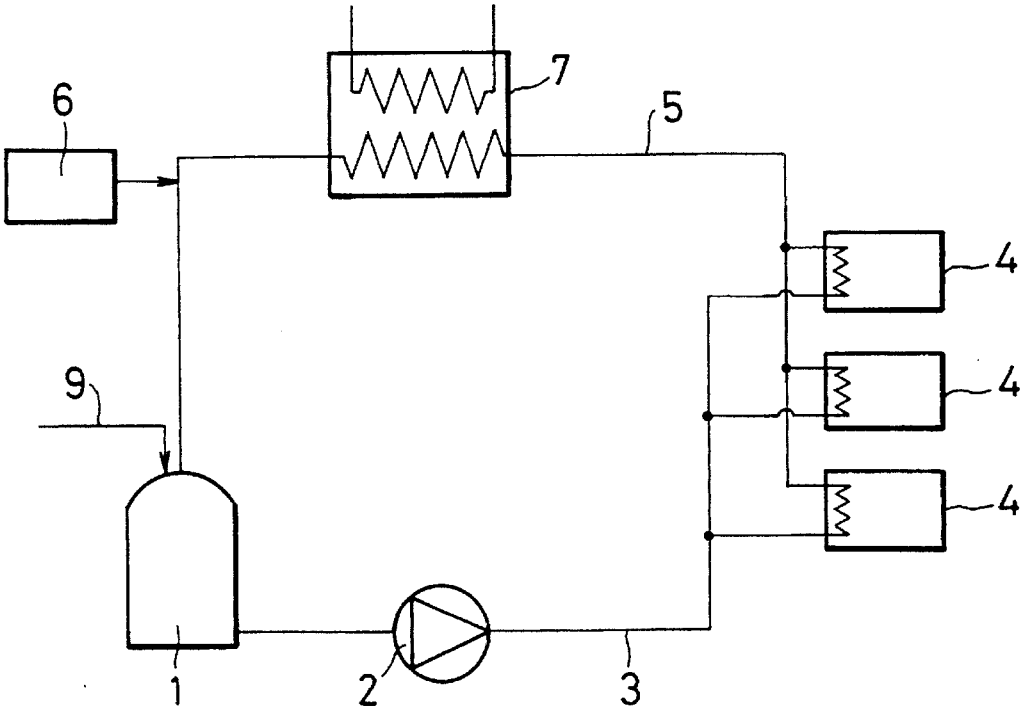
FIG. 1 is a concept diagram showing the apparatus cooling system of the present invention.

Using the apparatus cooling system having the construction depicted in FIG. 1, the antibacterial effects of the present invention were investigated.

The pure water which is used as the cooling water is produced by treating municipal water in a reverse osmosis apparatus, an ion exchanging column, and ultrafiltration apparatus, in that order. The specific resistance of the pure water thus obtained was 3MΩ.cm.

Figure 3:
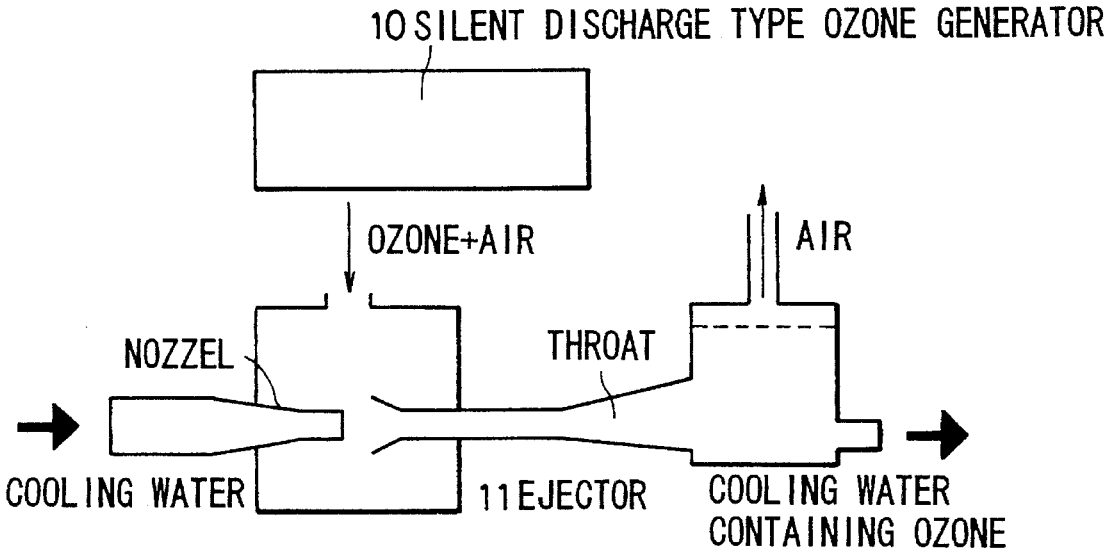
FIG. 3 is a concept diagram showing the composition of an ozone pouring apparatus.
Figure 4:
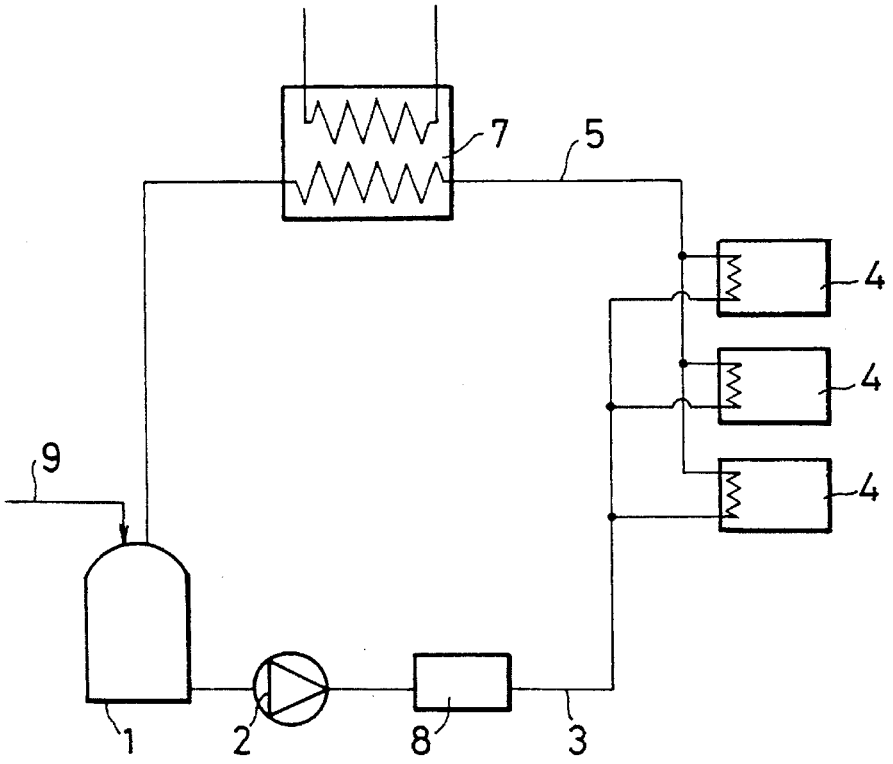
FIG. 4 is a concept diagram showing a conventional apparatus cooling system.

An apparatus comprising the silent discharge type ozone generator 10 and an injector shown in FIG. 3 is employed as the ozone supplying apparatus 6; this apparatus is attached to the piping between the heat exchanger 7 and water tank 1. A mixture of air and the ozone generated by means of the silent discharge of air is ejected from the nozzle portion of injector 11, as shown in FIG. 3, and ozone is dissolved in the cooling water at various concentrations. Furthermore, the air which is ejected together with the ozone is discharged externally downstream from the throat portion. The ozone concentration in the circulating cooling water is controlled by means of the adjustment of the amount of ozone generated by ozone generator 10.

The cooling water is sampled at the exit port of the water tank 1 and a measurement of the ozone concentration and bacterial count in the cooling water is conducted. Here, the measurement of the ozone concentration is carried out using an ozone meter 27501 made by Orbis Fayer. Furthermore, the bacteria count is carried out by filtering 1 liter of the cooling water with a 0.45 μm membrane filter, immersing this filter in a culture liquid, allowing this to stand for a period of 24 hours in an incubator at a temperature of 35° C., and counting the number of colonies which appear.

Figure 2:
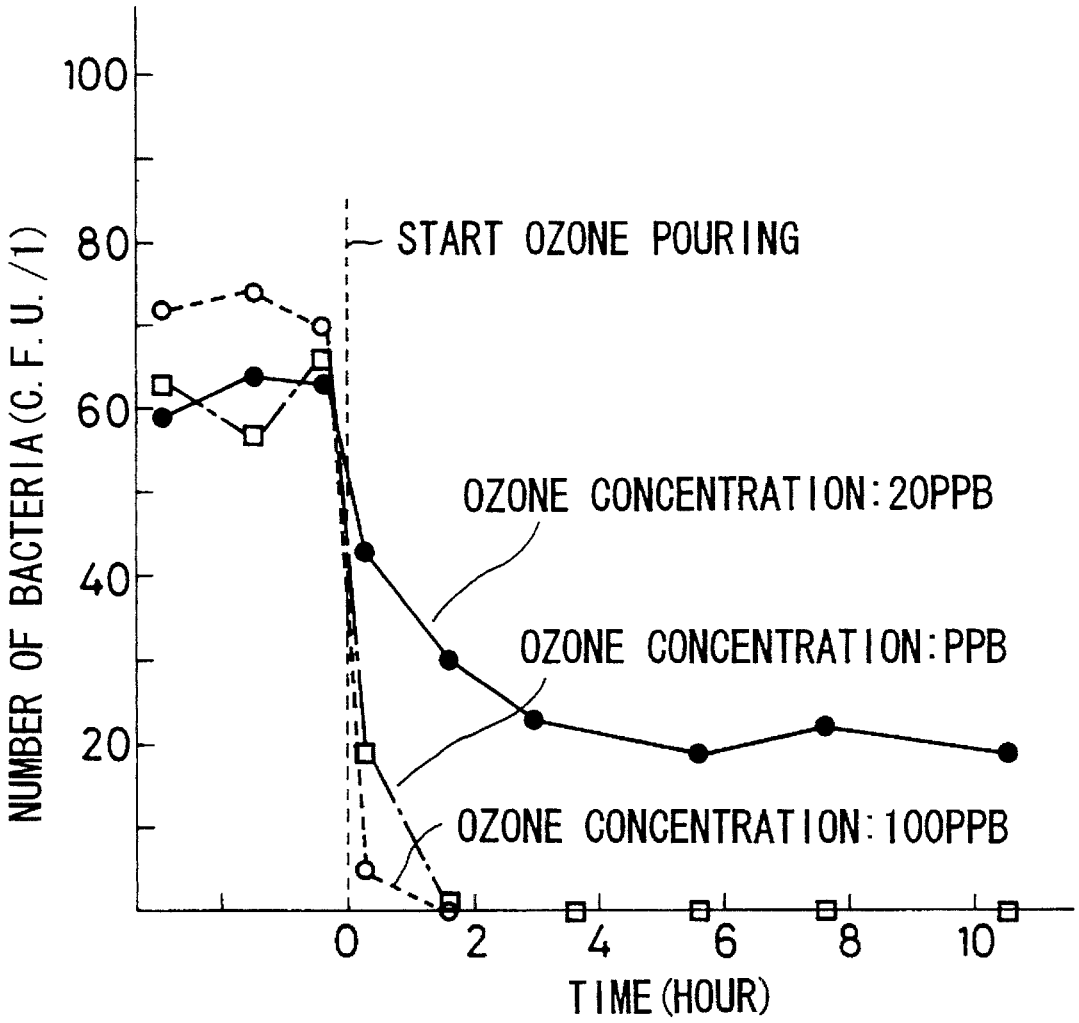
FIG. 2 is a graph showing the relationship between ozone concentration in the cooling water and the number of bacteria.

The results obtained are shown in FIG. 2. The figure shows the change over time in the number of bacteria in cooling water prior to ozone supply and after the initiation of ozone supply. The bacterial amount present in the cooling water prior to ozone supply was approximately 60 CFU/l (CFU: Colony Formation Unit); however, as a result of supplying ozone, the number of bacteria decreased rapidly, and this decrease was more rapid as the ozone concentration rose. At a concentration of 20 ppb, the bacterial count decreased; however, it was impossible to completely remove the bacteria, and they remained essentially stable at a level of 20 CFU/l. At ozone concentrations greater than 50 ppb, the number of bacteria decreased rapidly as a result of ozone supply, and at 2 hours after the initiation of ozone supply, the number of living bacteria reached 0. This indicated that if ozone were supplied at concentrations greater than 50 ppb, it would be possible to completely prevent the appearance of bacteria in the cooling water.

Next, in order to investigate the antibacterial effects of ozone with respect to various types of living bacteria, ozone concentrations were found which killed 99% of living bacteria within a period of 10 minutes, with respect to the bacteria shown in Table 1. The results are shown in column 2 of Table 1.

TABLE 1

| Bacterium | C99 (ppb) |
|---|---|
| *Escherichia coli* | 1.0 |
| *Streptococcus fecalis* | 1.5 |
| *Mycobacterium tuberculosis* | 50.0 |
| *Poliovirus* | 10.0 |
| *Endomocba hisdytica* | 30.0 |

C99: Concentration necessary to kill 99% of bacteria within 10 minutes

Table 1 shows that the ozone concentration necessary for the killing of bacteria by ozone differed among the various types of bacteria; it was determined that even in the case of the bacteria requiring the highest ozone concentration, Mycobacterium tuberculosis, an ozone concentration of 50 ppb exhibited sufficient antibacterial activity.

The results given above showed that if ozone was supplied in such a manner that the ozone concentration in the cooling water was always at a level of 50 ppb, it would be possible to completely prevent the appearance of bacteria, and furthermore, even if bacteria entered the system externally, they could be immediately killed, so that the decrease in heat exchanging efficiency of the cooling water piping system, and the increase in pressure loss resulting from the increase in bacteria could be prevented.

Industrial Applicability

By means of the present invention, the appearance of bacteria within the system can be prevented, so that the decrease in the heat exchanging efficiency of the piping system, the increase in water flow resistance, and the blockage of the piping system can be prevented. As a result, it is possible to provide an apparatus cooling system which is capable of stably maintaining a high cooling efficiency.

What is claimed is:

1. A system for cooling an apparatus comprising:

a water tank containing a purified water having a specific resistance of at least 1MΩ.cm, and from which calcium carbonate and silica components have been removed, pipings for outwardly introducing said purified water from said water tank to the apparatus to be cooled and returning said purified water from the cooled apparatus to said water tank, pump means for circulating said purified water through said pipings, and means for supplying ozone into said purified water.

2. A method of cooling an apparatus which comprises:

storing a purified water having a specific resistance of at least 1MΩ.cm, and from which calcium carbonate and silica components have been removed;

supplying ozone into said purified water;

introducing the ozone-containing purified water to the apparatus to be cooled so as to collect heat therefrom;

withdrawing a heated purified water from the apparatus;

passing the withdrawn water through a heat exchanger so as to obtain a cooled water; and returning the cooled water to the storing tank.

3. A method of cooling an apparatus in accordance with claim 2, wherein the purified water has an ozone concentration of at least 50 ppb.

4. A system for cooling an apparatus in accordance with claim 1, wherein said means for supplying ozone into said purified water is situated in piping between a heat exchanger and said water tank.

5. A system for cooling an apparatus in accordance with claim 1, wherein said means for supplying ozone into said purified water comprises an ozone generating portion and ozone injecting portion.

6. A system for cooling an apparatus in accordance with claim 5, wherein said ozone generating portion comprises a silent discharge ozone generator.

7. A system for cooling an apparatus in accordance with claim 5, wherein said ozone injecting portion comprises an ejector.

8. a system for cooling an apparatus in accordance with claim 7, wherein said ejector includes a nozzle portion for injecting a mixture of air and ozone generated from air by silent discharge ozone generator.

9. A system for cooling an apparatus in accordance with claim 8, wherein said ejector is arranged such that said air which is ejected together with said ozone is discharged externally downstream from a throat portion of said ejector.

* * * * *